United States Patent [19]

Prester

[11] Patent Number: 4,535,395

[45] Date of Patent: Aug. 13, 1985

[54] LAMP

[76] Inventor: Lorrain W. Prester, Box 38, Dorchester, Nebr. 68343

[21] Appl. No.: 521,026

[22] Filed: Aug. 8, 1983

Related U.S. Application Data

[62] Division of Ser. No. 859,304, Dec. 12, 1977.

[51] Int. Cl.[3] ..... F21V 29/00

[52] U.S. Cl. ..... 362/267; 362/308; 362/375; 362/396; 362/398; 362/399

[58] Field of Search ..... 362/267, 308, 375, 396, 362/398, 399

[56] References Cited

U.S. PATENT DOCUMENTS 3,175,079 3/1965 Giesler ..... 362/267

*Primary Examiner*—Stephen J. Lechert, Jr.
*Attorney, Agent, or Firm*—Vincent L. Carney

[57] ABSTRACT

To permit sufficient illumination for a plastic-sealed general purpose lamp, a bulb is encased in plastic and sealed, with the plastic shell of the lamp having wide parallel faces, one of which may include a reflector to focus light. The lamps may be battery or AC controlled and have a handle for holding them and a magnet mounted in them for mounting to a surface magnetically. To control the intensity and location of the light flux emitted from the lamp, a plastic lens and reflector may be incorporated in the lamp with the inner light bulb between the two. For greater power dissipation, dead space of approximately two cubic inches is placed around the lamp in some embodiments.

1 Claim, 9 Drawing Figures

96
98
108
106
104
112
100
110
102
116
118
120
114
132
128
130
122
124
126

96
144
146
136
142
140
138
148
133
154
131
135
150
152
129

174
180
168
178
164

160
176
172
170
16
184
162
182
167
176

LAMP

This application is a division of application Ser. No. 859,304, filed Dec. 12, 1977.

This invention relates to plastic-sealed general purpose lamps.

One class of lamp includes an incandescent inner lamp bulb sealed with an outer encasement of transparent plastic, with conductors extending therefrom for connection to a source of power. In the prior art lamps of this type, the lamps have been adapted for mounting to automobiles or for other special applications. They have generally not been used for higher illumination purposes such as work lamps because insufficient light was generally emitted from the lamps.

Work lamps are known which use incandescent lamps. However, these work lamps generally include a light bulb which is threaded into a socket and mounted to a reflector. The entire assembly is exposed to moisture and susceptible to damage from shock.

Accordingly, it is an object of the invention to provide a durable work lamp.

It is a further object of the invention to provide a lamp which is resistant to shock and emits light at relatively high intensities.

It is a still further object of the invention to provide a lamp which may be mounted for use in different manners.

It is a still further object of the invention to provide an inexpensive lamp suitable for mass production.

It is a still further object of the invention to provide a watertight, plastic-sealed lamp which is capable of providing a relatively high-intensity light over a relatively small area.

In accordance with the above and further objects of the invention, an incandescent inner light bulb is sealed in a plastic housing, which has relatively narrow edges and relatively wide sides so that a substantial amount of light is emitted through the wide sides. A magnet is encased in the plastic so as to permit magnetic mounting of the lamp, and the lamp is adaptable to be connected through twisted pairs to a battery source or through a transformer to a main supply. In one embodiment, it may also be used as a plug-in type lamp.

The lamps are sealed so as to be watertight and resistant to shock. In one embodiment, a reflector and lens combination are included to focus the light for suitable intensity. A dead space is incorporated between the reflector and the lens so as to permit a higher-wattage inner lamp to be incorporated within the casing.

As can be understood from the above description, the lamp of this invention has several advantages, such as: (1) it is shock resistant; (2) it is sealed against moisture; (3) it may be mounted for use in different ways or hand-held; (4) it may be mass produced and adapted for different configurations such as a plug-in configuration or connection through a twisted pair; and (5) it is capable of emitting substantial light through at least one of its surfaces so as to be useful as a work lamp or so as to be visible at a distance.

The above-noted and other features of the invention will be better understood from the following detailed description when considered with reference to the accompanying drawings in which.

Figure 1:
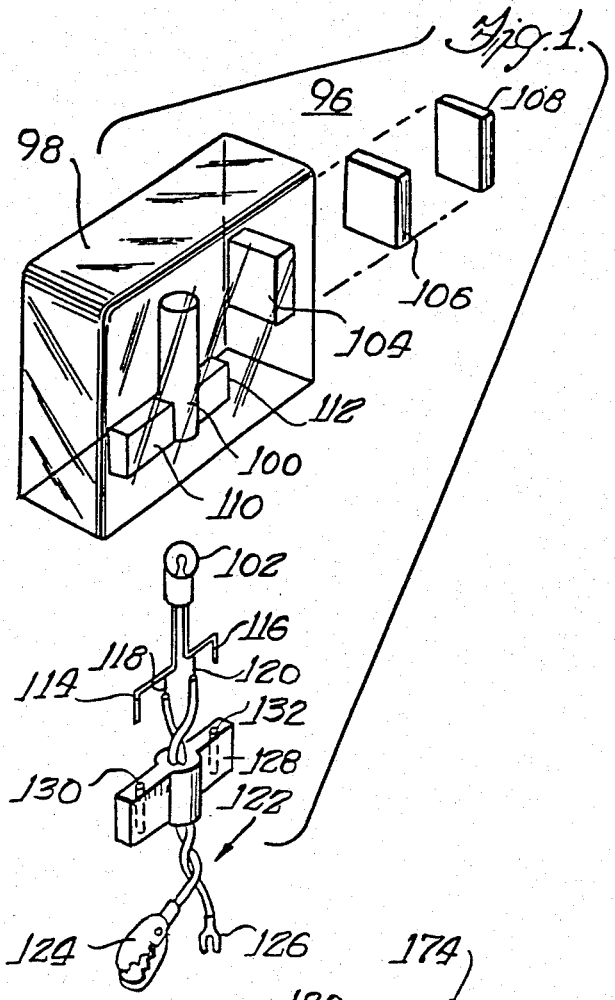
FIG. 1 is an exploded perspective view of one embodiment of the invention.

In FIG. 1, there is shown a conbination lamp 96 including as its principal parts a housing 98, a lamp recess 100, an inner lamp 102, a magnet recess 104 and a magnet 106.

The housing 98 is generally in the shape of a right regular parallelepiped having four narrow faces forming respectively a base face, a top face, a side face, and two vertical edge faces and having two of relatively large radiating sides. It is substantially solid and formed of a clear plastic material such as Lucite or the like to permit light to be radiated therefrom. The cylindrical recess 100 in the housing 98 extends upwardly from the base face to receive the inner lamp 102.

One of the vertical edges includes the magnet recess 104 into which fits the complementary-shaped ceramic magnet 106. The magnet 106 is held in place by a plastic Lucite plug 108 that fits over it and is also formed of Lucite in the preferred embodiment. The magnet 106, the recess 104 and the plastic insert 108 are of such a size that the magnet 106 fits tightly in the magnet recess 104 and is positioned from the edge a sufficient distance so that the Lucite plug 108 fits within the recess with its outer surface flush with the face. The plug 108 is sealed by heat or adhesive or the like to hold the ceramic magnet 106 in place. The inner lamp 102 fits within the cylindrical recess 100 with its socket being fully encompassed and its leads extending downwardly out of the housing 98.

To provide electrical connections to the inner lamp 102, two rectangular recesses 110 and 112 interconnect with the cylindrical recess 100 and receive outwardly-extending conductors 114 and 116 connected to opposite sides of the filament of the bulb 102. Additional conductors 118 and 120 are each respectively connected to a different one of the conductors 114 and 116 respectively. Conductors 118 and 120 are stripped for the electrical connection to conductors 114 and 116 but are otherwise insulated, with the insulation extending within the housing 98.

Externally of the housing 98, the insulated conductors 118 and 120 form a twisted pair 122. One of the conductors of the twisted pair is electrically connected to an alligator clip 124 and one end of the other of the conductors of the twisted pair is electrically connected to the spade clip 126 to form terminals for connection to positive and negative terminals of a battery. A stop member 128 includes two apertures 130 and 132 and is shaped to fit within the recesses 100, 110 and 112.

With the inner lamp 102 properly positioned within the cylindrical recess 100 and the conductors 114 and 116 properly positioned within the rectangular recesses 110 and 112 respectively, the outlet opening of the housing is sealed by the plastic plug or stop member 128. This plug includes two apertures 130 and 132 in one embodiment to receive the prongs connected to a battery source to which the light is mounted. In another embodiment, the apertures 130 and 132 are closed but the twisted pair 122 extends downwardly so that the combination lamp 96 may be immersed in water and be protected from the water by the Lucite housing which is completely sealed, with the conductors being protected by the insulation on the twisted pair 122.

In another embodiment, with the magnet 106 in place, the spade and alligator clips 126 and 124 are connected to a source of power and the lamp mounted by the magnet to metal such as to the body of an automobile while the lamp is being used. In still another embodiment, the combination 96 may be mounted by prongs to a handheld battery combination to serve as a handheld lamp.

With this construction, the same basic lamp may be mounted to different embodiments with slight modifications such as filling in the apertures 130 and 132 of the stop 128 and connecting the twisted part 122 or in the alternative, clipping the twisted pair off at the base and sealing the openings through which the conductors 118 and 120 extend while keeping the apertures 130 and 132 open to receive the prongs from a battery source. The magnet 106 may be included or may be omitted depending upon whether or not the lamp is to be attached magnetically to a surface and powered through the twisted pair 122. In all embodiments, the largest amount of light flux is omitted from the wide surfaces rather than from the edge so that the opaque magnet 106 does not seriously impede use of the lamp.

Figure 2:
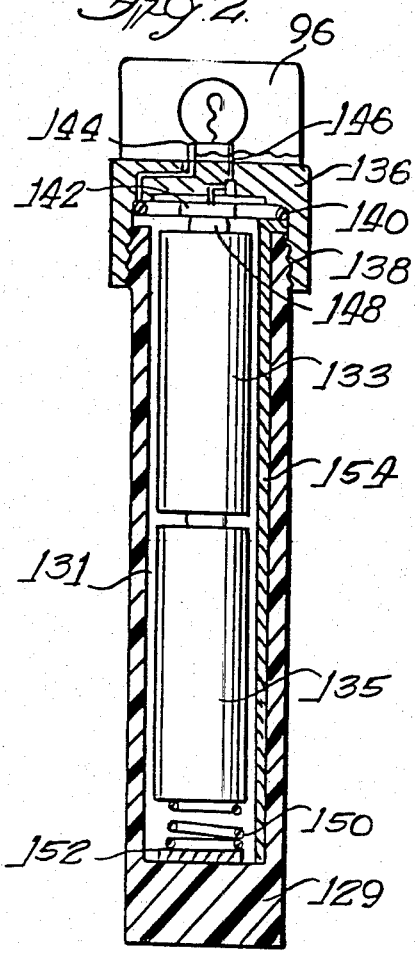
FIG. 2 is a sectional view of another embodiment of the invention.

In FIG. 2, there is shown an embodiment of lamp amounts for receiving the combination lamp 96, which mount utilizes the prong insert rather than the twisted pair of electrical connections 122. In this embodiment, the cylindrical casing 129 receives the combination lamp 96 and serves to contain the power for the lamp. This casing has an inner opening 131 to receive pen-light batteries 133 and 135. A flasher may be optionally included (not shown in FIG. 2) to provide a flashing light rather than a steady light.

To mount the combination lamp 96 to the casing 129, the casing 129 includes a cap 136 having internal threads which match external threads on the casing 129 at 138 to permit the cap to be screwed over the recess containing the batteries 133 and 135. The cap 136 includes a metallic ring 140 and a metallic plate 142, with the metallic ring 140 being electrically connected to a first prong 144 and the plate 142 being connected to a metallic prong 146. The plate 142 is positioned to contact the positive terminal 148 to one of the pen-light batteries to provide a source of positive potential to one of the conductors of the combination lamp 96 when the lamp is mounted on the prongs 144 and 146. The prongs 144 provide a negative or ground connection.

To provide a negative or ground connection to the circuit, the casing 129 includes a spring 150 at the bottom of the hollow compartment 131, positioned between the pen-light battery 135 and the metallic plate 152. The metallic plate 152 is connected by a metallic conductor 154 which runs along the side of the hollow interior 131 of the casing 129 to the ring 140 of the cap 136 when the cap is threaded tightly down on the casing 129. In the preferred embodiment, the prongs 144 and 146 are permanently mounted to the cap 136, but they may, instead, be permanently mounted to the combination lamp 96.

With these connections, the combination lamp 96 is illuminated by tightening the cap 136 downwardly on the casing. In the alternative, the casing may include a switch (not shown) in series with portions of the conductor 154 to break the electrical circuit including the combination lamp 96 when the switch is in one position and to complete it when the switch is in the other position.

Figure 3:
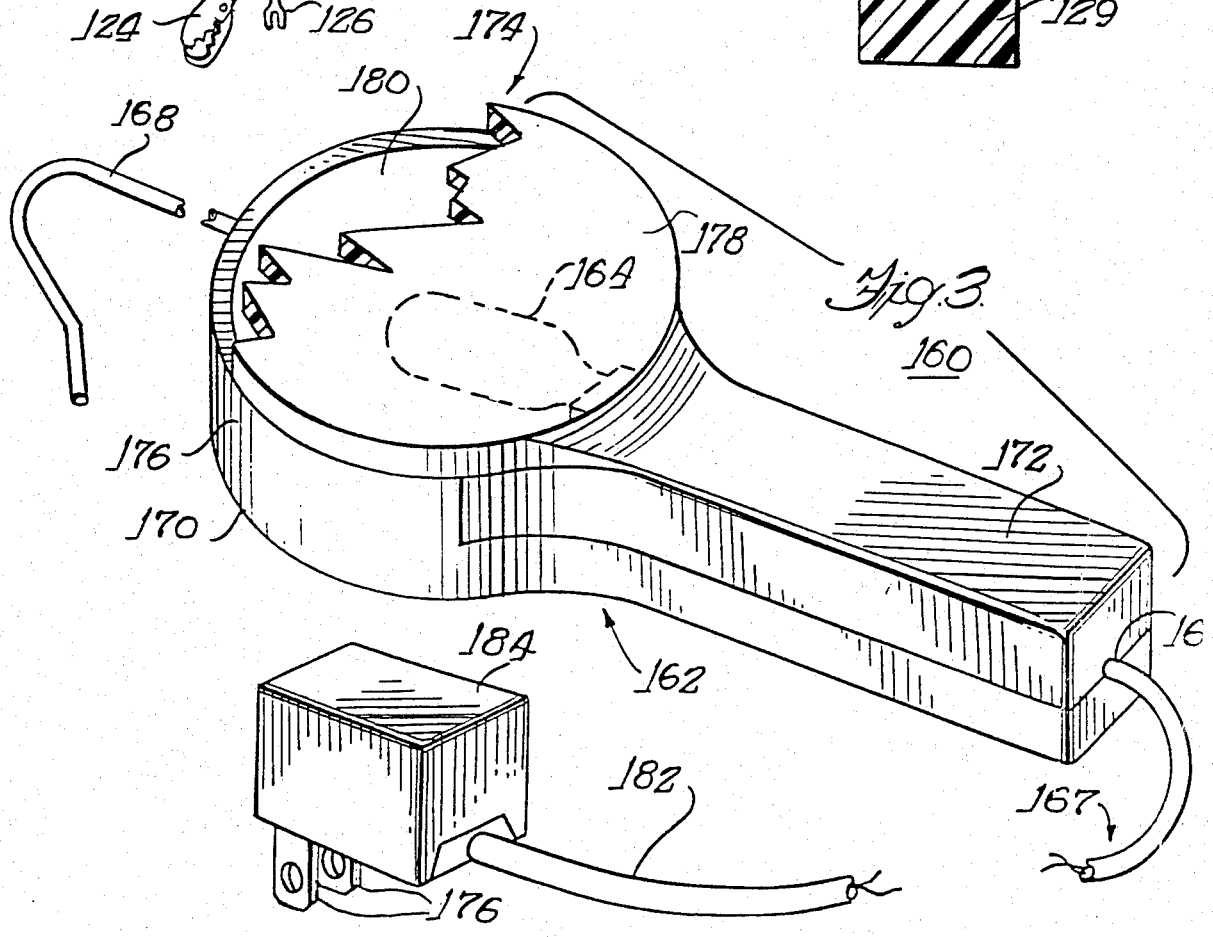
FIG. 3 is a perspective view of still another embodiment of the invention.

In FIG. 3, there is shown a perspective view of another embodiment of combination lamp 160 having as its principal parts a housing 162, an inner lamp 164, a conductor recess 166, a hook 168 and a magnet 170.

The housing 162 includes a handle portion 172 and a lamp portion 174. The handle portion 172 is generally in the shape of a right-regular parallelepiped elongated so as to be easily gripped and forming a back support for the magnet 170 and the lamp portion 174. The lamp portion 174 has a cylindrical side wall 176 and a curved lens 178, with the magnet 170 being located on the opposite side of the lamp portion from the lens 178. Internally of the lamp portion, beyond the lamp 164 is a parabolic reflector 180. The inner lamp 164 is mounted by a flexible adhesive within the housing 162, with its light-emitting portion over the focal point of the parabolic reflector 180 and aligned with the center of the curved outer lens 178.

With the exception of the parabolic reflector 180, the housing 162 and hook 168 are a durable polycarbonate, which is transparent, and passes light over the portions not frosted nor colored. The particular polycarbonate selected is sold by General Electric Corporation under the trade designation Lexan 3. The parts are held together and cushioned by a resiliant adhesive sold under the designation RTV by General Electric Corporation. While Lexan 3 and RTV are used in the preferred embodiment, it is apparent that many other plastics, especially polycarbonates, and resilient adhesives may be used instead.

Some portions of the lamp are ultrasonically welded instead of being sealed by the resilient plastic and this is particularly true of the lens 178. With the use of the resilient plastic and ultrasonic welding, a completely waterproof unit is fabricated.

The power source 167 includes a cord 182 and a transformer 184, with the transformer 184 and electrical male connector prongs 186, for connection to the ordinary mains supply. The transformer 184 steps the voltage down to 12 volts from the 110 V main source for use in the lamp 160. Instead of the transformer 184, alligator and spade clips may be used as in the embodiments of FIGS. 1 and 2 to provide directly the 12 volt DC voltage for the lamp.

Figure 4:
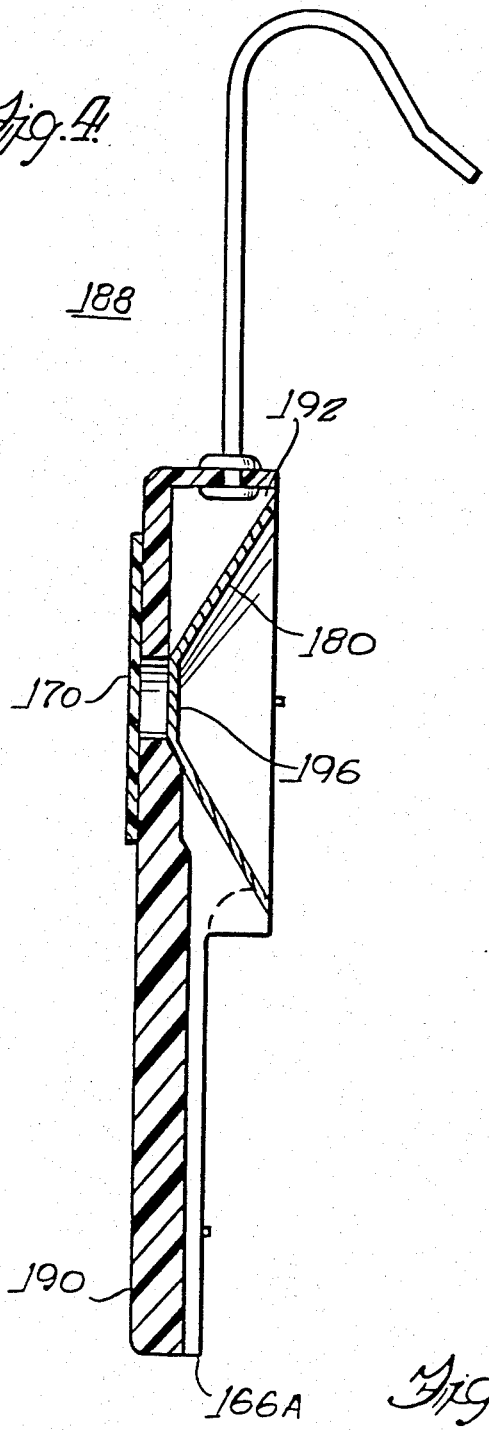
FIG. 4 is a side view of a portion of the embodiment of FIG. 3.

In FIG. 4, there is shown a separately-molded portion 188 including a ribbed handle portion 190 (shown in FIG. 5) and frusto-conical and magnet section 192 having within it the frusto-conical mirror 180 and having mounted to its back surface the cylindrical magnet 170. The frusto-conical mirror 180, is acrylic, coated with a reflective material on its inner surface. Other shapes such as parabolic may, of course, also be used. The shape and size are selected to provide intense light over a wide enough area to be useful.

In the preferred embodiment, the sides of the frusto-conical mirror 180 are inclined 32° from the horizontal and 58° from the vertical. The open mouth of the cone is approximately 2.90 inches in diameter and the bottom truncated portion is approximately 0.2625 inches in radius. A centrally-located longitudinally-extending groove 166A is formed in the bottom portion of the handle 190 and extends into the mirror section to accommodate the cord 182. (Shown in FIG. 3).

Figure 5:
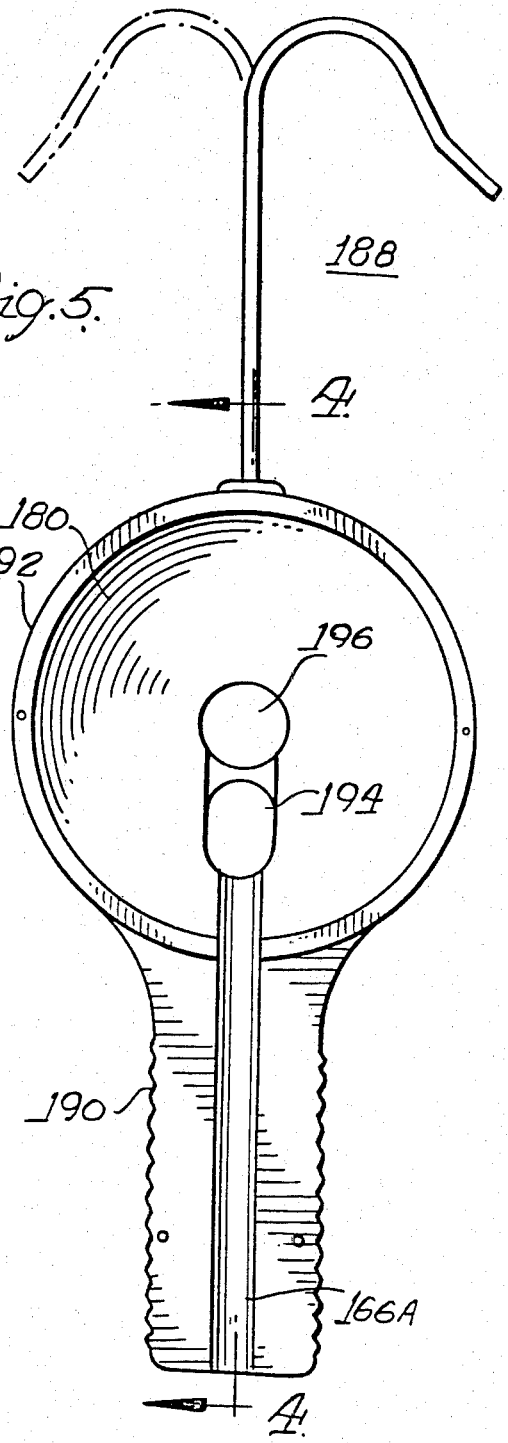
FIG. 5 is a plan view of a portion of the embodiment of FIG. 3.

As best is shown in FIG. 5, the groove 166A in the handle 190 extends into the mirror section 192 where it terminates in a lamp socket-holding aperture 194. The lamp socket is fastened in the aperture 194 with its bulb extending over the central flat portion 196 of the mirror. It is fastened by the resilient adhesive mentioned hereinabove. Electrical connection is made to the socket and the cord is laid in the groove 166A.

Figure 6:
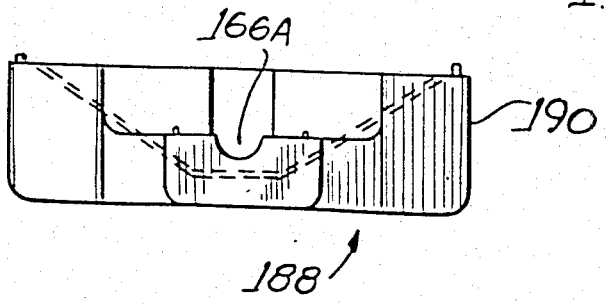
FIG. 6 is an end view of a portion of the embodiment of FIG. 3.

In FIG. 6, there is shown an end view of the handle 190 showing the longitudinal slot 166A. The height of the handle 190 is approximately 0.8 of an inch and the width is approximately 1 inch for ease in handling.

Figure 7:
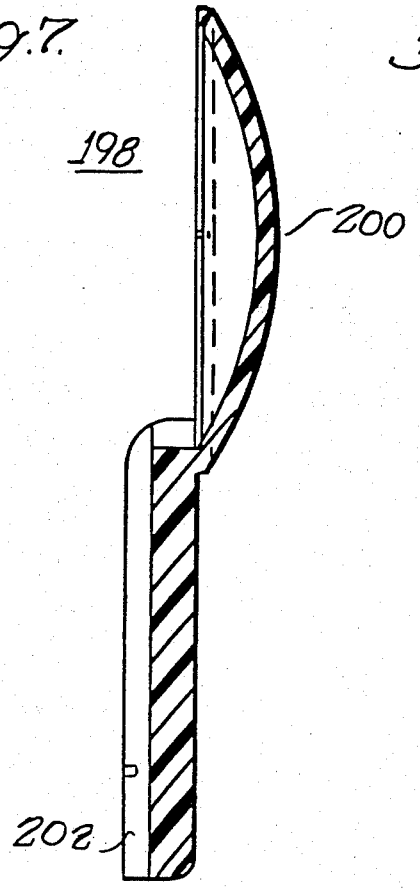
FIG. 7 is a side elevational view of still another portion of the embodiment of FIG. 3.

In FIG. 7, there is shown the top portion 198 of the housing having a transparent plastic polycarbonate lens section 200 with a radius of curvature of 3 inches, and a top handle portion 202 shaped to fit complementarily over the mirror section and handle section 192 and 190 respectively (FIGS. 4 and 5). The transparent lens section and mirror section form a dead air space which prevents overheating of the bulb by permitting some convection and, operates without such overheating.

It has been found that a 4 watt bulb requires a dead air space of approximately two cubic inches or more. In the preferred embodiment, the inner bulb is a GE 908 bulb.

Figure 8:
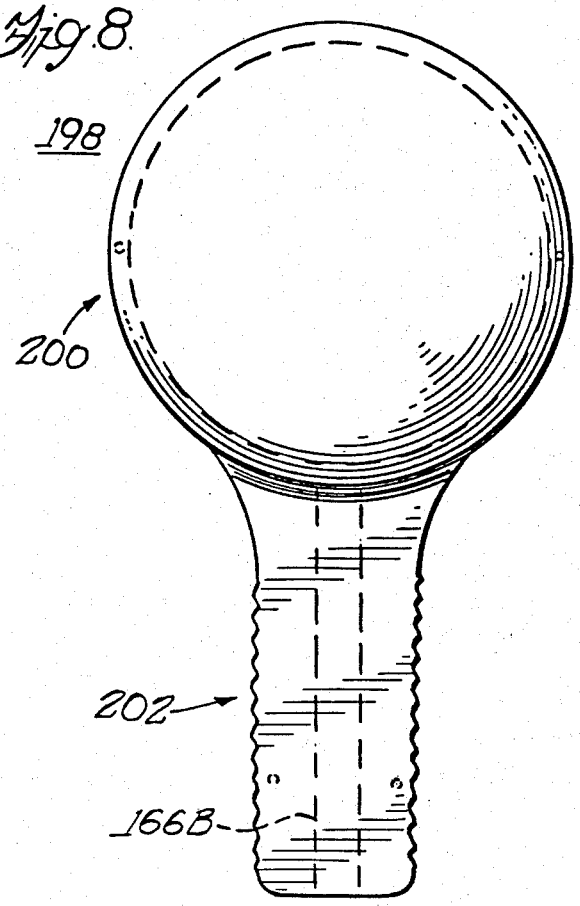
FIG. 8 is a plan view of still another portion of the embodiment of FIG. 3.

As shown in FIG. 8, the lens portion 200 is circular in plan view having a radius of 1.45 inches to its outer portion a radius 1.325 to its inner portion and has a slight downwardly-extending lip shown best in FIG. 7. The handle 202 includes, on its bottom side, a groove 166B shaped to fit complementarily with the groove 166A in the bottom portion 190 (FIGS. 4–6) to permit the cord to pass between the lamp and an external location. This groove may be sealed ultrasonically or by the flexible adhesive mentioned previously to make the equipment watertight.

Figure 9:
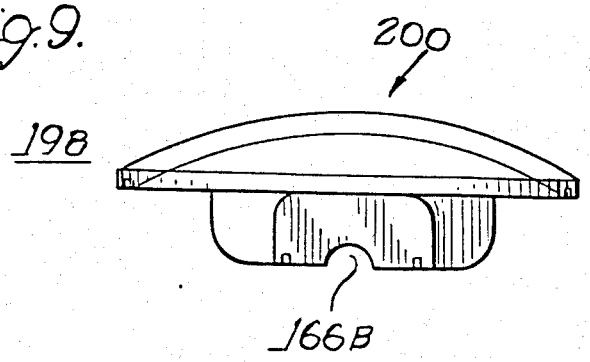
FIG. 9 is an end view of a portion of the embodiment of FIG. 3.

As can best be seen in conjunction with FIGS. 6 and 9, the longitudinal slots 166A and 166B when aligned, have flat surfaces which are adjacent to each other and that contact each other to form a seal. The lens extends slightly above the work lamp to radiate light in a beam which provides sufficient light without excessive dissipation. The lamp may be held by magnet to any surface or may be held in the hand.

What is claimed is:

1. A lamp comprising;

an incandescent light bulb;

a clear plastic housing;

said light bulb being within said clear plastic housing;

said clear plastic housing having two relatively wide parallel walls and a narrower connecting edge;

conductors extending from said incandescent light bulb and being electrically connected to opposite ends of the filament thereof;

said housing including internal walls forming an opening communicating with said conductors;

means for electrically connecting said conductors to an external source of electrical power;

a magnet;

said magnet being embedded in said plastic housing, whereby said lamp may be magnetically mounted above a work place;

said handle being integrally formed with said plastic housing and said conductors extending through said handle;

said housing including a reflector and a plastic lens;

said reflector and lens being positioned on opposite sides of said incandescent light bulb;

said plastic lens being shaped as a convex lens; and said lens being integrally formed with at least a portion of said handle.

* * * * *